US007322470B2

(12) United States Patent
Brunson

(10) Patent No.: US 7,322,470 B2
(45) Date of Patent: Jan. 29, 2008

(54) TOOL CONTAINER

(75) Inventor: Mark E Brunson, Bel Air, MD (US)

(73) Assignee: Black & Decker Inc., Newark, DE (US)

( * ) Notice: Subject to any disclaimer, the term of this patent is extended or adjusted under 35 U.S.C. 154(b) by 225 days.

(21) Appl. No.: 10/955,958

(22) Filed: Sep. 30, 2004

(65) Prior Publication Data

US 2006/0065557 A1 Mar. 30, 2006

(51) Int. Cl.
*B65D 85/28* (2006.01)

(52) U.S. Cl. ..... 206/372; 206/378

(58) Field of Classification Search ..... 206/372, 206/373, 377–379, 472–475, 349; 211/69, 211/70.6
See application file for complete search history.

(56) References Cited

U.S. PATENT DOCUMENTS

| | | | |
|---|---|---|---|
| 337,888 | A | 3/1886 | Swan |
| 470,567 | A | 3/1892 | Hitch |
| 498,455 | A | 5/1893 | Bartlett |
| 1,927,110 | A | 9/1933 | Bannister et al. |
| 2,487,174 | A | 11/1949 | Petre |
| 2,508,951 | A | 5/1950 | Kazimier |
| 2,601,101 | A | 6/1952 | Derham |
| D178,627 | S | 9/1956 | Baratelli |
| 2,792,934 | A | 5/1957 | Rocchetti |
| 2,844,244 | A | 7/1958 | Hanson |
| 2,880,857 | A | 4/1959 | Parsons et al. |
| 3,018,876 | A | 1/1962 | Huot |
| 3,276,847 | A | 10/1966 | Duff et al. |
| 3,367,483 | A | 2/1968 | Studen |
| 3,370,697 | A | 2/1968 | Levey et al. |
| 3,426,890 | A | 2/1969 | Bayer |
| 3,583,556 | A | 6/1971 | Wagner |
| D221,317 | S | 7/1971 | Muller |
| D229,366 | S | 11/1973 | Yonce |
| 3,904,034 | A | 9/1975 | Saunders |
| 4,048,051 | A | 9/1977 | Gretz |
| 4,253,830 | A | 3/1981 | Kazen et al. |
| 4,340,140 | A | 7/1982 | Wilcox et al. |
| D269,648 | S | 7/1983 | Wilcox et al. |
| 4,446,966 | A | 5/1984 | Moloney |
| 4,489,830 | A | 12/1984 | Charlebois et al. |

(Continued)

FOREIGN PATENT DOCUMENTS

| | | |
|---|---|---|
| DE | 1085810 | 7/1960 |

(Continued)

*Primary Examiner*—Shian T. Luong
(74) *Attorney, Agent, or Firm*—Harness, Dickey & Pierce, P.L.C.

(57) ABSTRACT

A tool container comprising two housing members and an insert. The two housing members are pivotally coupled with one another for opening and closing with respect to one another. At least one housing member defines a cavity for receiving tools. The cavity is defined by a base and a wall extending from the base. At least one of the wall and the base include a plurality of first retaining features. The insert is operable to retain at least one tool. The insert has a surface with a plurality of second retaining features operable to cooperate with the first retaining features to secure the insert at one of a variety of positions within the housing members. The insert includes an elastomeric portion operable to engage and retain the tool.

24 Claims, 16 Drawing Sheets

U.S. PATENT DOCUMENTS

| | | | | |
|---|---|---|---|---|
| 4,576,307 | A | 3/1986 | Frydenberg | |
| 4,615,464 | A | 10/1986 | Byrns | |
| D291,946 | S | 9/1987 | Dottori et al. | |
| 4,778,047 | A | 10/1988 | Lay | |
| 4,838,445 | A | 6/1989 | Lanius | |
| 4,884,689 | A | 12/1989 | Su-Chin | |
| 4,974,740 | A | 12/1990 | Niles et al. | |
| D314,669 | S | 2/1991 | Kunimune | |
| 5,031,768 | A | 7/1991 | Fischer | |
| 5,454,748 | A * | 10/1995 | Gottschald | 451/41 |
| 5,525,314 | A * | 6/1996 | Hurson | 422/300 |
| 5,553,710 | A | 9/1996 | Takama | |
| 5,560,480 | A * | 10/1996 | Singleton | 206/373 |
| 5,593,058 | A | 1/1997 | Spencer et al. | |
| 5,775,499 | A * | 7/1998 | Budert | 206/379 |
| 5,893,457 | A * | 4/1999 | Wei | 206/373 |
| 6,415,922 | B1 | 7/2002 | Lee | |
| 6,516,948 | B1 * | 2/2003 | Caballero | 206/373 |
| 6,755,302 | B1 | 6/2004 | Streich et al. | |
| 6,953,114 | B2 * | 10/2005 | Wang | 206/375 |
| 6,978,890 | B2 * | 12/2005 | Pangerc et al. | 206/349 |
| 2004/0069668 | A1 * | 4/2004 | Finnigan | 206/372 |
| 2004/0144671 | A1 * | 7/2004 | Hallee et al. | 206/373 |
| 2004/0200749 | A1 * | 10/2004 | Wang | 206/373 |
| 2004/0214052 | A1 * | 10/2004 | Rochelo | 429/9 |
| 2005/0133394 | A1 * | 6/2005 | Liu | 206/349 |

FOREIGN PATENT DOCUMENTS

| | | |
|---|---|---|
| DE | 2319334 | 11/1974 |
| DE | 7821932 | 11/1978 |
| DE | 7837195 | 12/1978 |
| DE | 19822972 | 3/1999 |
| DE | 29823041 | 5/1999 |
| DE | 20012186 | 11/2000 |
| DE | 20014052 | 1/2001 |
| DE | 20307875 | 11/2003 |
| DE | 10359266 | 7/2004 |
| DE | 202005000494 | 6/2005 |
| EP | 0270845 | 11/1987 |
| NR | 1977800 | 1/1968 |
| WO | WO 86/00600 | 1/1986 |
| WO | WO 00/09421 | 2/2000 |
| WO | WO 01/74545 | 10/2001 |

* cited by examiner

TOOL CONTAINER

FIELD OF THE INVENTION

The present invention relates to tool containers and, more specifically, to containers that include inserts to retain the tools within the container.

BACKGROUND OF THE INVENTION

Tool users, whether casual or professional, desire to maintain their tools in some type of organized fashion. Tool organization enables a user to readily find the tool, use it, and return it to its place. Thus, several types of tool containers have been provided to serve such a function.

While the tool containers work satisfactorily for their designed purpose, these containers have their drawbacks. One such drawback is that some containers are not rugged enough to withstand the day-to-day punishment which a professional user subjects his tools to. Also, the containers may be large, awkward and difficult to be handled by the user. Further, the containers may not provide an aesthetic appearance.

SUMMARY OF THE INVENTION

The present invention provides the art with a tool container which overcomes the above shortcomings. The present invention provides the art with a tool case which is durable and easily manipulated by the user. The tool case is rugged enough to withstand the daily use of a professional user, while providing a pleasing aesthetic appearance.

In accordance with one aspect of the invention, the invention provides for a tool container comprising two housing members and an insert. The two housing members are pivotally coupled with one another for opening and closing with respect to one another. At least one housing member defines a cavity for receiving tools. The cavity is defined by a base and a wall extending from the base. At least one of the wall and the base include a plurality of first retaining features. The insert is operable to retain at least one tool. The insert has a surface with a plurality of second retaining features operable to cooperate with the first retaining features to secure the insert at one of a variety of positions within the housing members. The insert includes an elastomeric portion operable to engage and retain the tool. T In accordance with another aspect of the invention, the invention provides for a tool container comprising two housing members and an insert. The two housing members are pivotally coupled with one another for opening and closing with respect to one another. At least one housing member defines a first cavity for receiving tools. The first cavity is defined by a first base and a first wall extending from the first base. At least one of the first wall and the first base include a plurality of first retaining features. The insert has a second cavity for retaining items defined by a second base, a plurality of second walls extending from the second base, and a lid. At least one of the second base and the second walls include a plurality of second retaining features operable to cooperate with the first retaining features to secure the insert at one of a variety of positions within the housing members.

The present invention further provides for a tool container comprising a housing member and an insert. The housing member defines a cavity for receiving tools. The cavity is defined by a base and a wall extending from the base. The wall includes a first securement member. The insert is operable to retain at least one tool. The insert is multi-positionable in the housing member. The insert has a surface with a second securement member for cooperating with the first securement member to secure the insert within the housing member. The insert includes an elastomeric portion operable to engage and retain the tool.

The present invention still further provides for a tool container comprising a housing member and an insert. The housing member defines a first cavity for receiving tools. The first cavity is defined by a first base and a first wall extending from the first base. The first wall includes a first securement member. The insert has a second cavity for retaining items defined by a second base, a plurality of second walls, and a lid. At least one of the second base and the second walls extends from the second base includes a plurality of second securement members operable to cooperate with the first securement member to secure the insert at one of a variety of positions within the housing members.

The present invention further provides for a method of making a tool container. The method comprises the following steps: providing a housing member having a cavity for receiving tools, the cavity defined by a base and a wall extending from the base, the wall includes a first securement member; providing an insert for retaining tools, the insert being multi-positionable in the housing member, the insert having a surface with a second securement member for cooperating with the first securement member to secure the insert within the housing member, the insert includes an elastomeric portion operable to retain the tools.

The invention further provides for a method of making a tool container comprising the following steps: providing a housing member having a first cavity for receiving tools, the first cavity is defined by a first base and a first wall extending from the first base, the first wall includes a first securement member; providing an insert having a second cavity for retaining items defined by a second base, a plurality of second side walls, and a lid, at least one of the second side walls extending from the second base includes a plurality of second securement members operable to cooperate with the first securement members; and positioning and securing the insert at a desired position within the first base through cooperation between the first and second securement members.

The invention still further provides for a tool container comprising a housing member and an insert. The housing member defines a cavity for receiving tools. The cavity is defined by a base and a wall extending from the base. The wall includes a first securement member. The insert retains at least one tool in an orientation approximately perpendicular to the base. The insert is multi-positionable in the housing member. The insert has a surface with a second securement member for cooperating with the first securement member to secure the insert within the housing member. The insert includes an elastomeric portion operable to engage and retain the tool.

Other objects, features and advantages of the present invention will become more fully apparent from the following detailed description of the preferred embodiment and the accompanying drawings.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
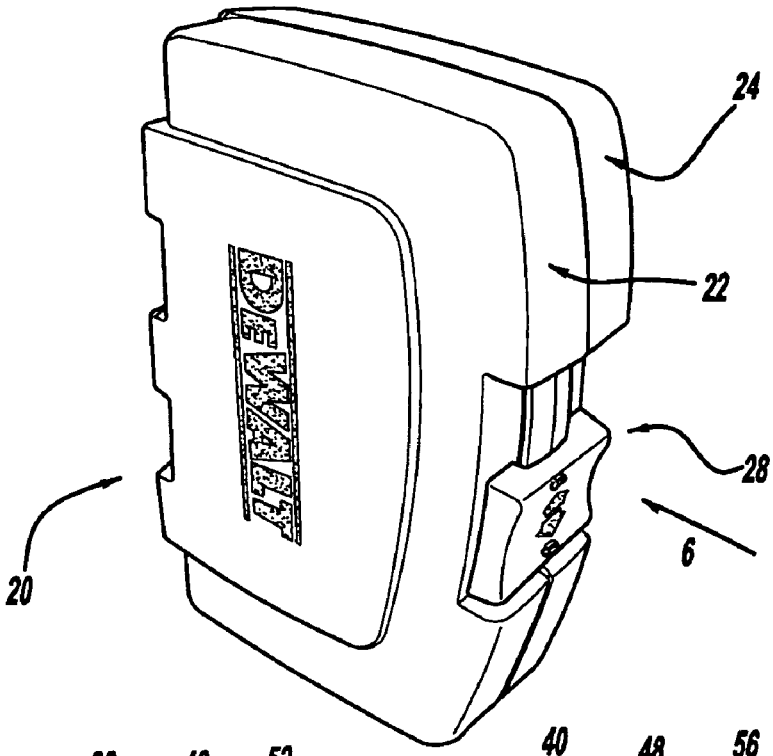
FIG. 1 is a perspective view of a tool container of the present invention in a closed position.

Turning to the figures, particularly FIG. 1, a tool container is shown and designated with the reference numeral 20. The tool container 20 includes two housing members 22 and 24, which are pivotally secured together by a hinge 26. The housing members 22, 24 also include a locking mechanism 28 to maintain the container 20 in a closed position.

Figure 2:
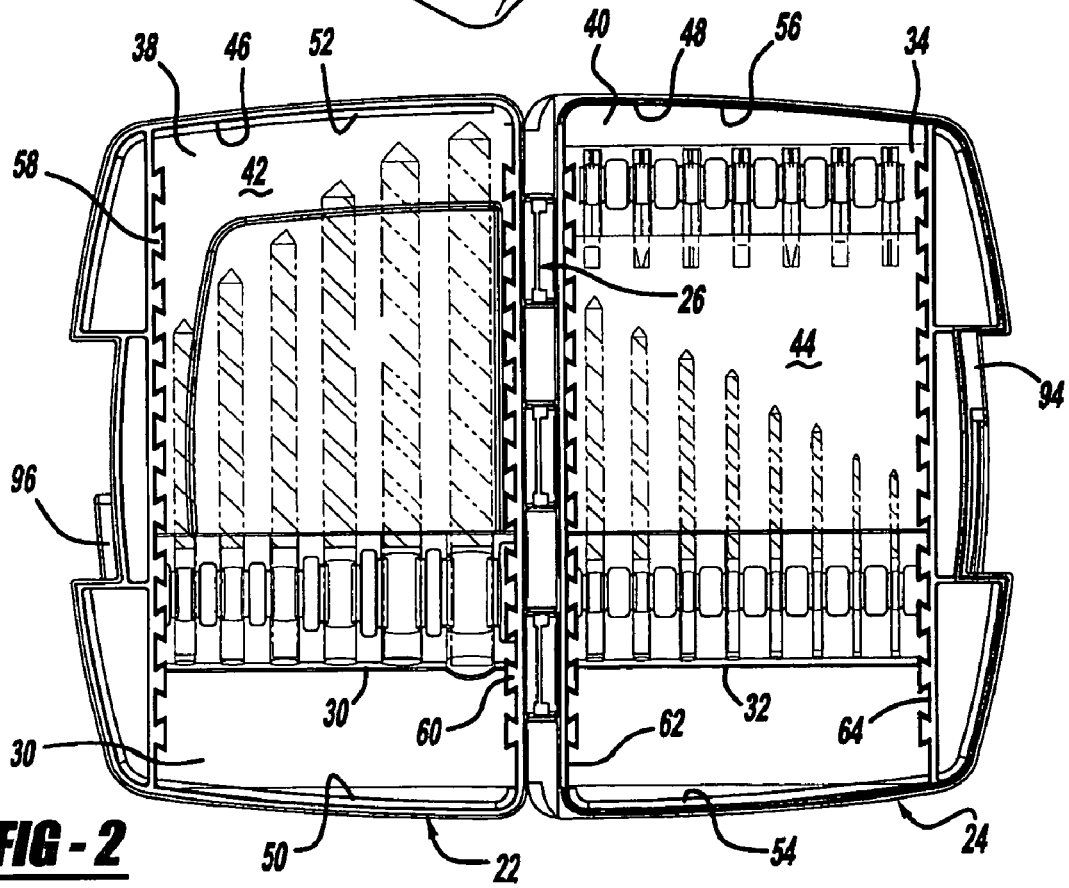
FIG. 2 is a perspective view of the tool container of the present invention in an open position.

Turning to FIG. 2, the container 20 is illustrated in an open position. Each half may include one or more tool retaining inserts 30, 32, 34. The tool retaining inserts may retain tool bits or the like, such as drill bits and screwdriver bits.

Figure 3:
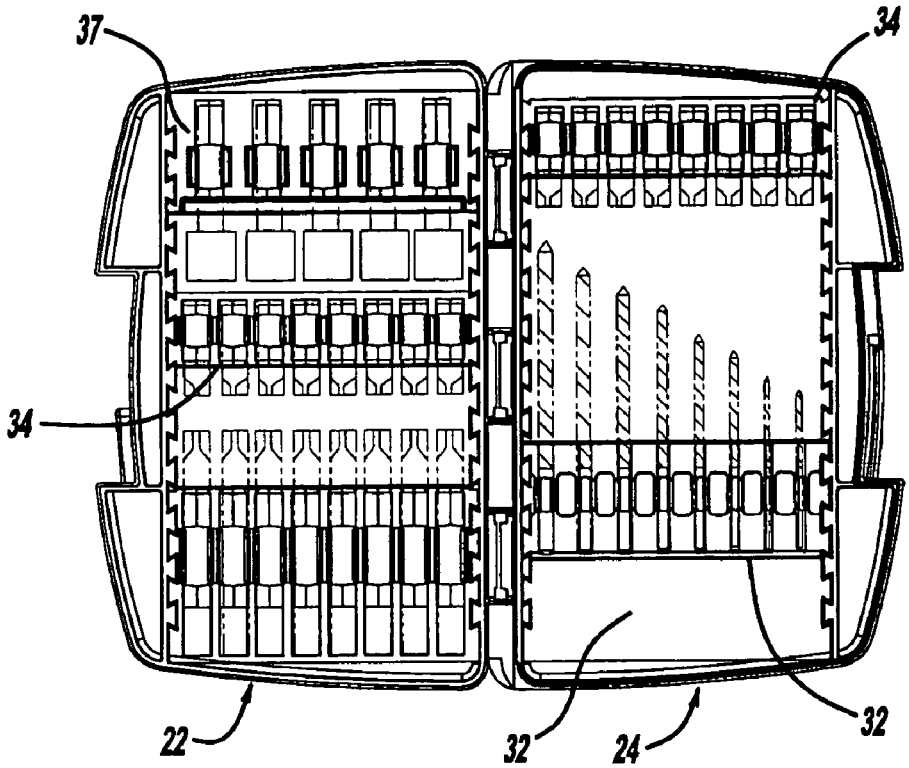
FIG. 3 is a plan view like that of FIG. 2 illustrating multiple inserts.
Figure 4:
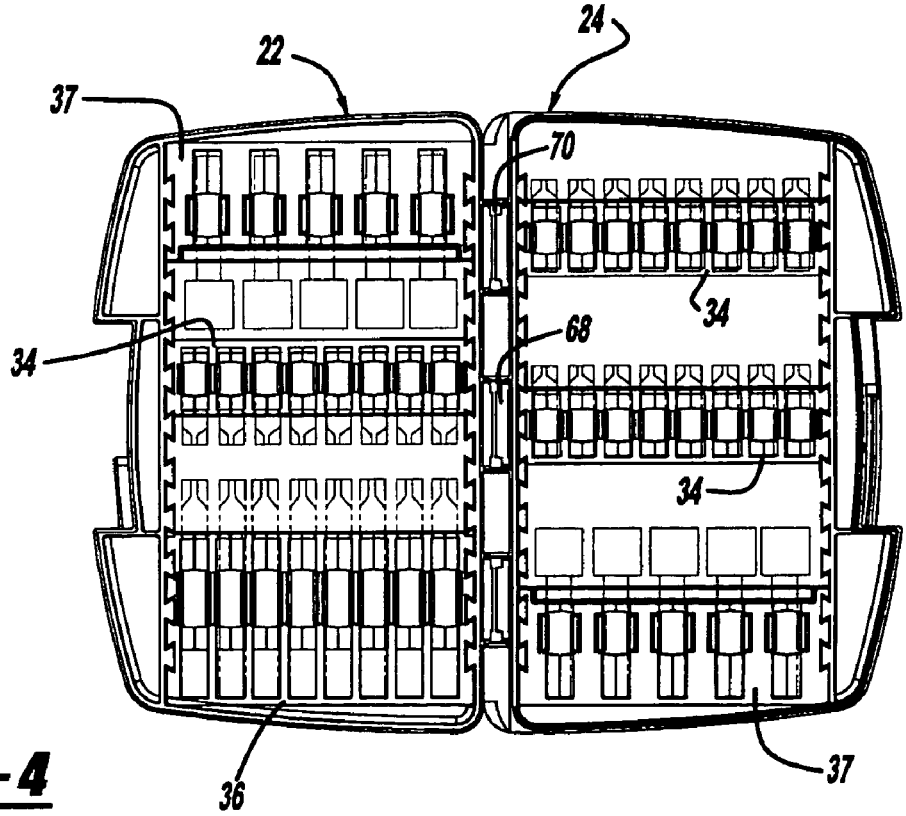
FIG. 4 is a view of FIG. 2 illustrating multiple inserts positioned in other multiple positions.

FIGS. 3 and 4 illustrate embodiments like FIG. 2. Here, inserts 32, 34, 36 and 37 are shown in multiple positions in the housing members 22 and 24. As can be seen, the inserts may be positioned at a plurality of different predetermined positions or orientations in each housing member 22, 24. Any one of the insert and housing mating surfaces enable the accurate positioning and orientating in the housing members. The plurality of positions enhances the versatility of the tool container.

The housing members 22 and 24 are substantially similar and include cavities 38 and 40 defined by a base 42, 44 and a peripheral wall 46, 48. The housing members 22, 24 have an overall rectangular shape with the peripheral walls 46, 48 defining lateral walls 50, 52, 54, 56 and longitudinal walls 58, 60, 62, 64. The longitudinal walls 60 and 62 at their open ends include hinge members 68. Hinge member 68 has an overall C-shape which snap fits onto the pin member 70. The pin members 70 are separated by barrel members 72. Thus, the hinge 26 enables the housing members 22 and 24 to pivotally open and close the container 20.

Figure 5:
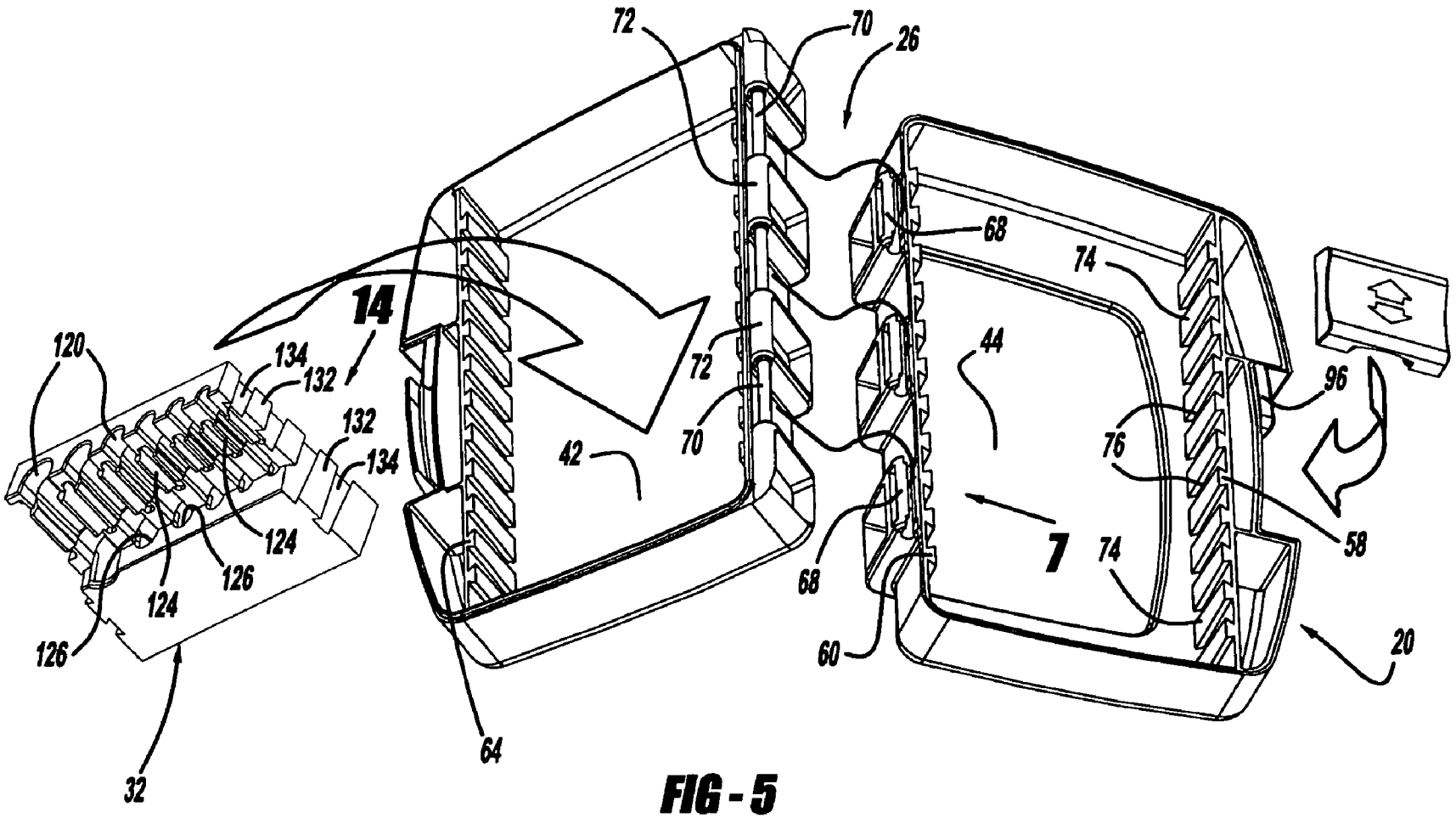
FIG. 5 is an exploded view of FIG. 2.
Figure 10:
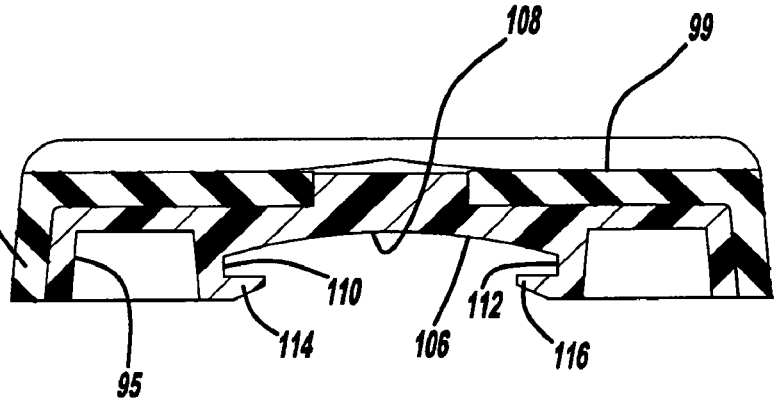
FIG. 10 is a cross-section view through the latch of FIG. 9.
Figure 7:
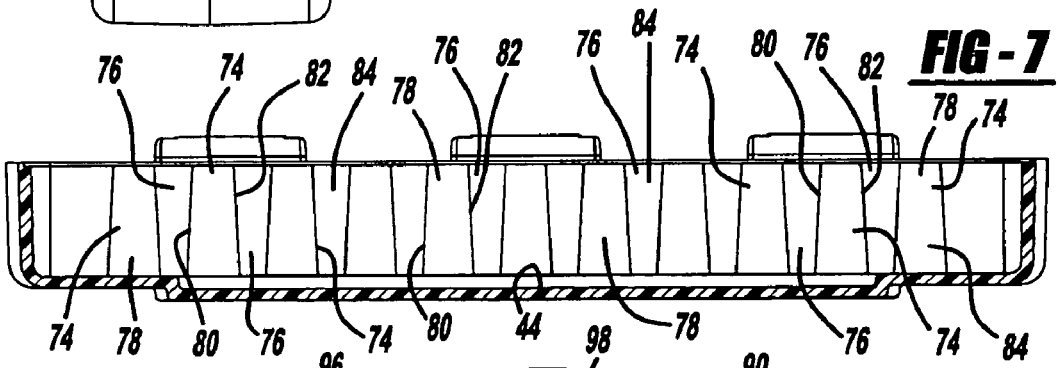
FIG. 7 is a plan view of FIG. 5 in the direction of arrow 7.

Referring to FIGS. 5 and 7, the longitudinal walls 58, 60, 62, 64 include a plurality of alternating dove-tail tenons 74 and recesses 76. The tenons 74 are narrower at the top and become wider at the base, having an overall trapezoidal shape. The tenons 74 have a front face 78 which is angled with respect to vertical at an angle of about one (1°) degree. Also, the tenons 74 have side faces 80 and 82 which also define the sides of the recesses 76, which are likewise angled with respect to vertical at an angle of about two (2°) degrees. Further, the recesses 76, which are defined by the side faces 80 and 82, include a rear face 84. The rear face 84 is angled with respect to the vertical. Also, the recess 76 has a larger opening at the top of the wall which becomes narrow or tapered near the base 42, 44 to have an overall trapezoidal shape. The tenons 74 and recesses 76 have a dove-tail shape and are adapted to receive the corresponding dove-tail recesses and tenons, respectively, of the tool retaining inserts 30, 32, 34, 36, 37 as seen in FIG. 10. Once the tenons and recesses of the walls and inserts are coupled with one another, due to the wedging action of the friction forces, they become substantially permanently retained within the housing cavities.

Figure 6:
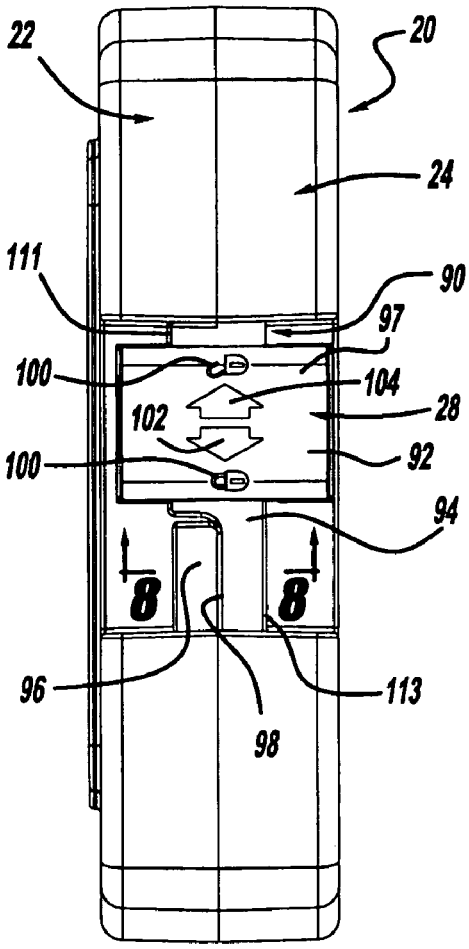
FIG. 6 is a plan view of FIG. 1 in the direction of arrow 6.
Figure 8:
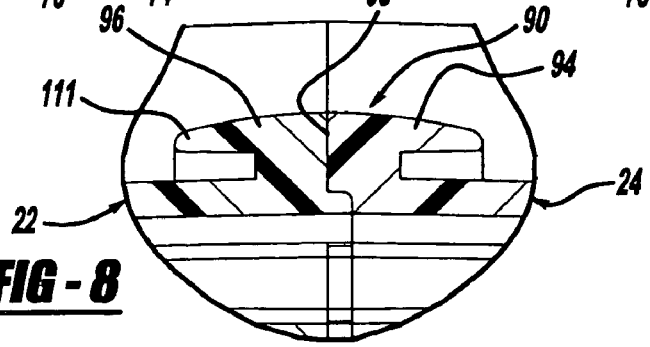
FIG. 8 is a cross-section view of FIG. 6 along line 8-8 thereof.
Figure 12:
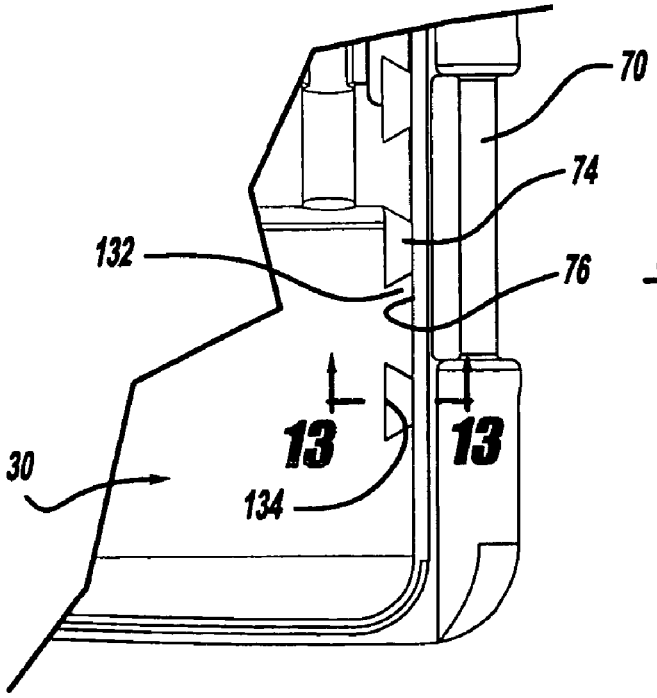
FIG. 12 is an enlarged partial plan view of FIG. 2.
Figure 13:
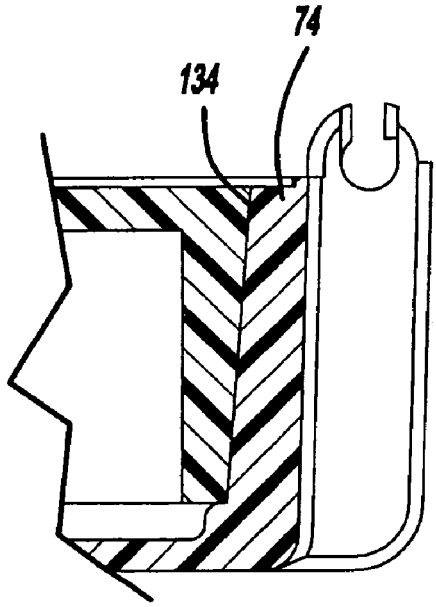
FIG. 13 is a cross-section view of FIG. 12 along line 13-13 thereof.
Figure 14:
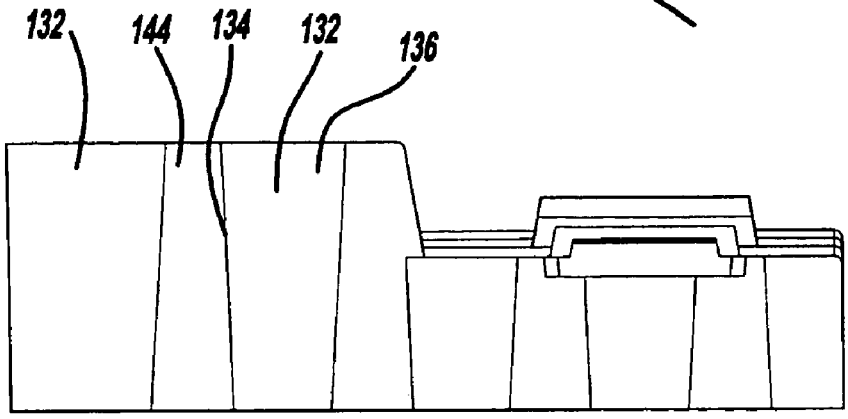
FIG. 14 is a plan view along arrow 14 of FIG. 5.
Figure 15:
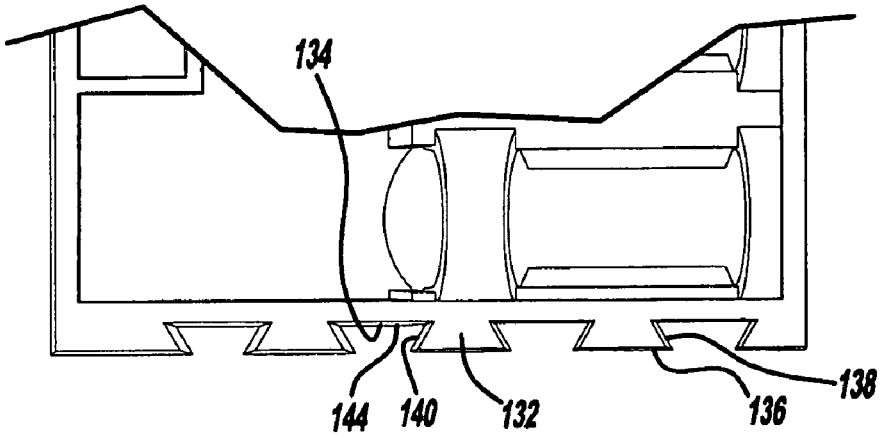
FIG. 15 is a partial plan view of the insert of FIG. 5.
Figure 21:
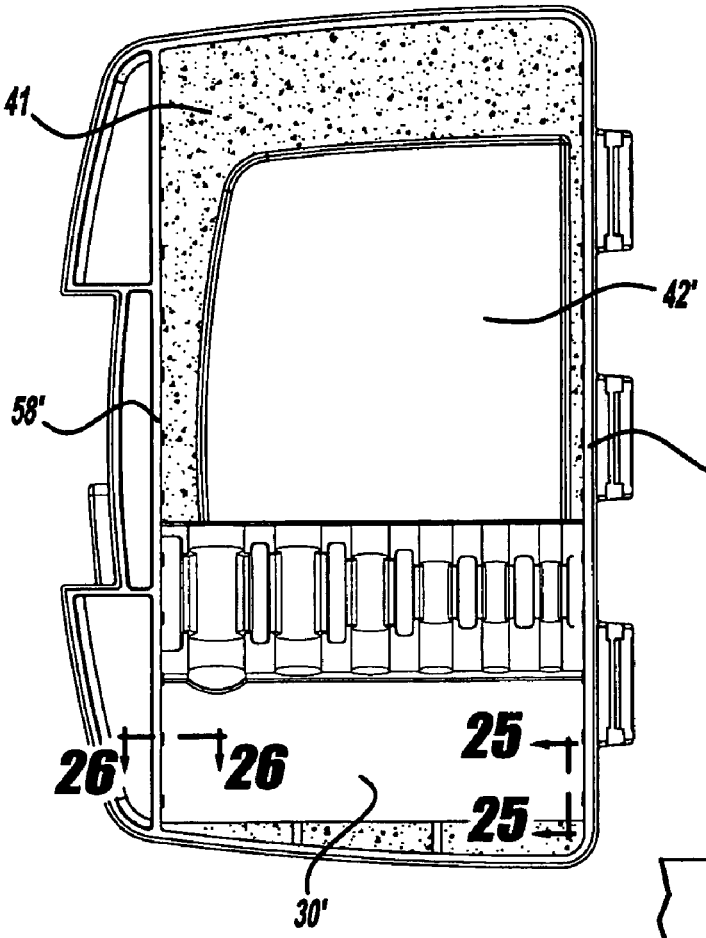
FIG. 21 is a view like FIG. 2 of an alternate embodiment of the present invention.
Figure 25:
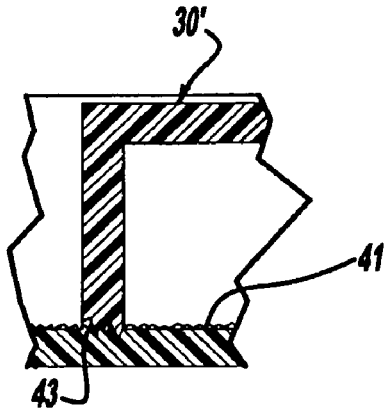
FIG. 25 is a cross-section view of FIG. 21 along lines 25-25 thereof.

Referring now to FIGS. 6 and 8, the locking mechanism 28 includes a rail 90 and a latch 92. The rail 90 includes rail portions 94 and 96 on the housing pair 22 and 24. The housing portion 94 extends above the longitudinal wall 64 to retain the latch 92 when the latch is in an unlocked position. The rail portion 96, approximately half the width of the rail 90, fits into a cut-out 98 in the rail portion 94 so that in a closed position, as illustrated in FIG. 6, the rail 90 appears continuous so that when the latch is moved to a locked position, the rail portion 96 as well as the rail portion 94 are held together by the latch 92.

With respect to FIGS. 2-5, the rail portions 94 and 96 are arcuate along the longitudinal axis of the rail 90. Likewise, the rail portions 94 and 96 are arcuate in a direction transverse to the longitudinal axis as seen in FIG. 8. Thus, the rail 90 is arcuate in two planes. The arc of the rail in the longitudinal direction follows with the overall contour of the tool container. The transverse arc enables better removal of the housing member from the mold die.

Figure 9:
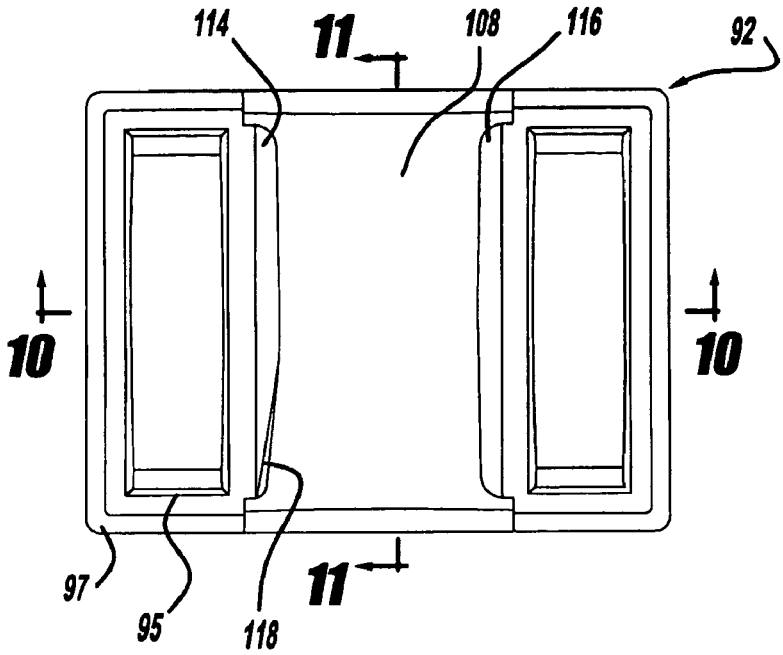
FIG. 9 is a rear plan view of the latch in accordance with the present invention.
Figure 11:
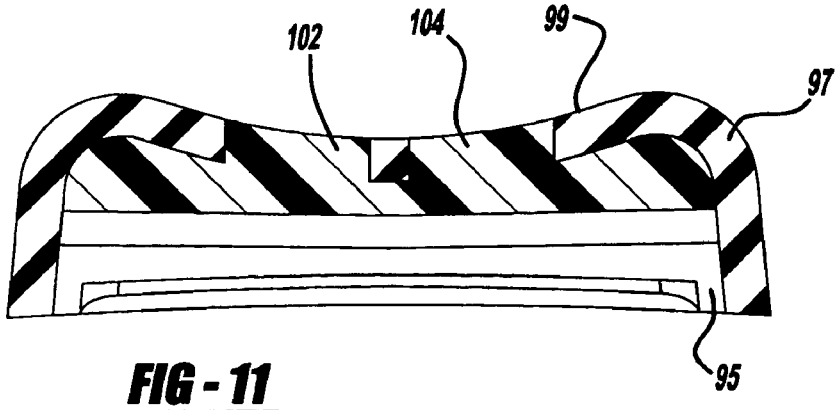
FIG. 11 is another cross-section view through the latch in FIG. 9.

In FIG. 9, the latch 92 has an overall rectangular shape. The latch is formed from a first rigid polypropylene member 95 and a second krayton soft cover 97. The cover is molded on top of the rigid base 95 to provide a soft gripping surface for the user. The cover follows the contour of the first member 94. Thus, the latch 92 has an outer arcuate surface adapted to be contacted by the user's thumb. The arcuate surface enables the thumb to rotate and have an ergonomic feel as it is moved between the locked and unlocked positions. The outer arcuate surface 99 includes indicia 100 formed in the cover member 97. The indicia indicates the locked and unlocked position. Also, as shown in FIGS. 6 and 11, the first member 95 includes indicia members 102 and 104 which project into the cover 97. The indicia members 102 and 104 also have an arcuate outer surface consistent with the contour of the first member 94. The indicia 102 and 104 are arrows indicating movement of the latch 92 and are flush with the cover 97 as illustrated in FIG. 9. Also, the arrows 102 and 104 are preferably yellow in color while the cover as well as indicia 100 are black. This provides a contrasting aesthetic appearance for the user.

The latch 92 also includes a channel 106 for receiving the rail portions 94 and 96. The channel 106 is defined by an arcuate base 108, a pair of opposing side walls 110 and 112, and a pair of opposing flanges 114 and 116 extending toward one another from the walls 110 and 112. Thus, the channel 106 includes an arcuate base 108 which conforms to the arcuate rails and has flanges 110, 112 to secure with the ends 111, 113 of the rails 90. Also, one of the flanges 114 includes a cut-out portion 118. The width of the channel between the flanges is substantially constant. However, at the cut-out 118, the width is larger than the remaining channel. Thus, as flange 116 is captured under rail end 113, and cut-out 118 contacts rail end 111, the larger width channel at the cut-out 118 enables flange 114 to easily snap on to rail end 111, to secure the latch 92 with the rails 90. Also, the arcuate surface 108 is arcuate along the channel axis as well as transverse to the channel axis. Thus, the surface 108 is arcuate in two directions to follow the contour of the rail. The substantially matching arcuateness of both the channel and the rails enables smooth movement of the latch 92 along the rail 90.

The tool-retaining inserts 30, 32, 34, 36, 37 include a plurality of tool-receiving recesses 120 and a plurality of tool-retaining fingers 124. The tool is placed into the recess and is maintained in the recess by the retaining fingers 124. The tool retaining inserts 30, 32 may have a stepped configuration with a plurality of curved cut-outs 126 enabling the tools to be inserted into the stepped portion to receive the tools.

The sides of the inserts 30, 32, 34, 36, 37 include mating tenons and recesses 132 and 134 to mate, respectively, with recesses 76 and tenons 74, respectively, of the housing members 22, 24 (see FIGS. 14-17). The tenons 132 have angled front faces 136 and angled sides 138 and 140. They are angled with respect to the vertical at an angle of about one (1°) and two (2°) degrees, respectively. Also, the tenons 132 are larger at the top and smaller at the bottom of the insert to provide an overall trapezoidal shape. The recesses 134 are defined by the walls 138, 140 of the tenons and include an angled base 144. The base is larger at the bottom and smaller at the top of the insert to provide an overall trapezoidal shape. Thus, the tool retaining insert 30, 32, 34, 36, 37 is positioned inside of the housing members 22, 24 so that a wedging friction fit is maintained between the housing members and the inserts. The friction fit is such that the tool retaining inserts are substantially permanently maintained in the housing halves.

Figure 16:
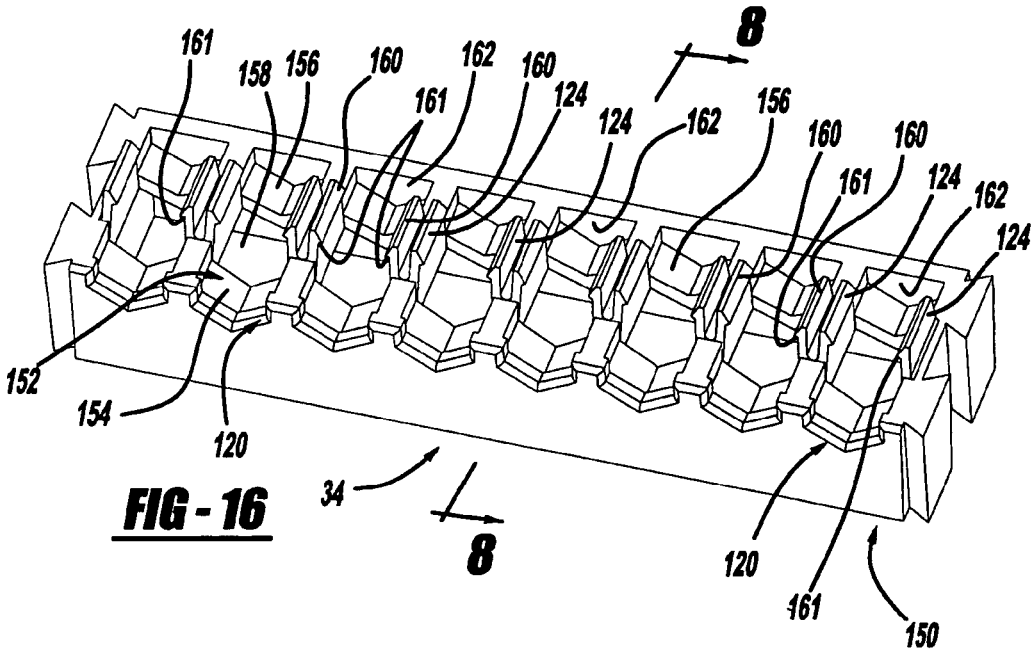
FIG. 16 is a perspective view of a tool receiving insert in accordance with the present invention.
Figure 17:
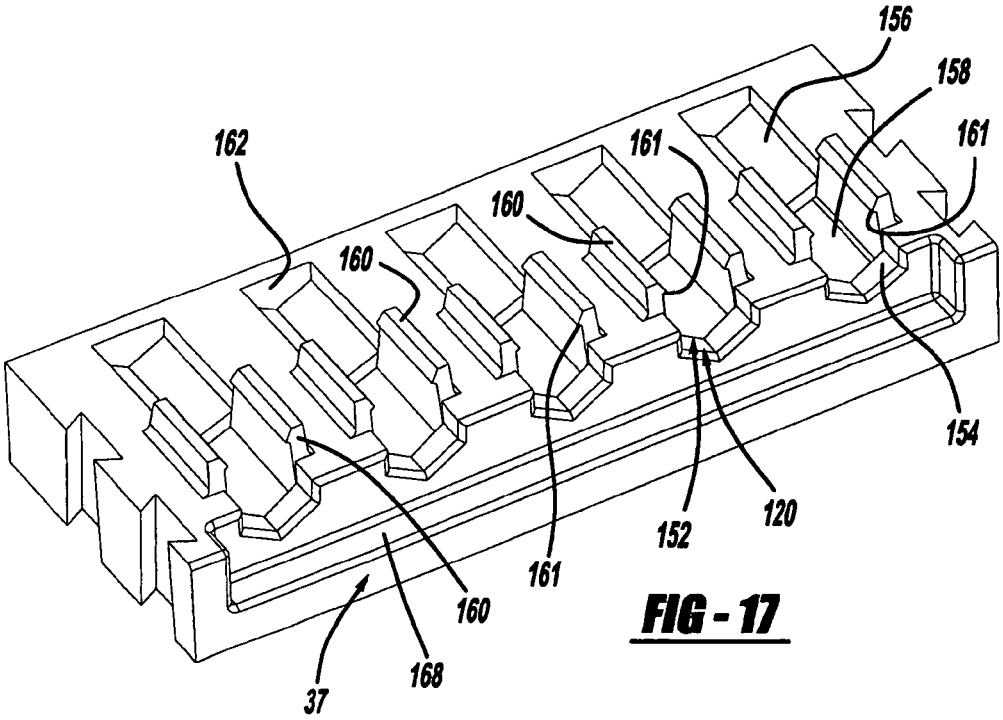
FIG. 17 is a perspective view of another tool receiving insert of the present invention.

Turn to FIGS. 16 and 17 for a better understanding of the inserts 34, 36, 37. FIG. 16 illustrates a perspective view of the insert 34. Here, the insert 34 has a body 150 with eight tool receiving recesses 120. Each tool receiving recess 120 includes a pair of tool retaining fingers 124 on each side of the tool receiving recess 120. The tool receiving recesses 120 include a V-shaped tool receiving cradle 152. The V-shaped tool receiving cradle 152 is separated into two cradle portions 154 and 156 by an aperture 158. The aperture 158 enhances the molding of the insert as well as providing flex for the fingers 124 when they are spread apart to receive a tool as will be described herein.

The fingers 124 are positioned adjacent the aperture 158 and include a barbed member 160 at the free end of the fingers 124. The barbs 160 include a flat surface 161 which helps to retain a tool bit in the V-shaped cradle 152. Also, a wall member 162 is positioned on one side of the tool receiving cradles 152. The wall 162 provides an abutment surface to help in the positioning of tools within the cradle 152. The insert 34 has a longitudinal length of about three-quarters (¾") of an inch. The insert 36 is substantially the same as insert 34 except the insert 36 has a longitudinal length about two and one-half (2½) times that of insert 34. Thus, a pan portion 164 is formed between the wall 162 and second cradle portion 156. The insert 36 has eight receiving recesses 120 like those described in insert 34.

Turning to FIG. 17, insert 37 is illustrated. Insert 37 is similar to insert 34 except that insert 37 includes five tool receiving recesses 120. The tool receiving recesses are substantially the same as those previously described, having a V-shaped cradle 152 as well as the fingers 124. The insert 37 includes a stepped portion 168 which enables other types of tools such as sockets to be retained in the insert 37. However, any cradle shape having an apex would be able to receive a tool apex.

Figure 18:
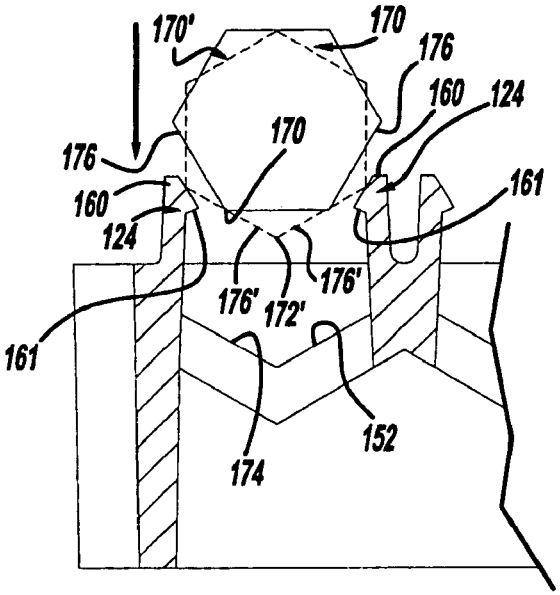
FIG. 18 is a cross-section view of FIG. 16 along line 18-18 thereof.
Figure 19:
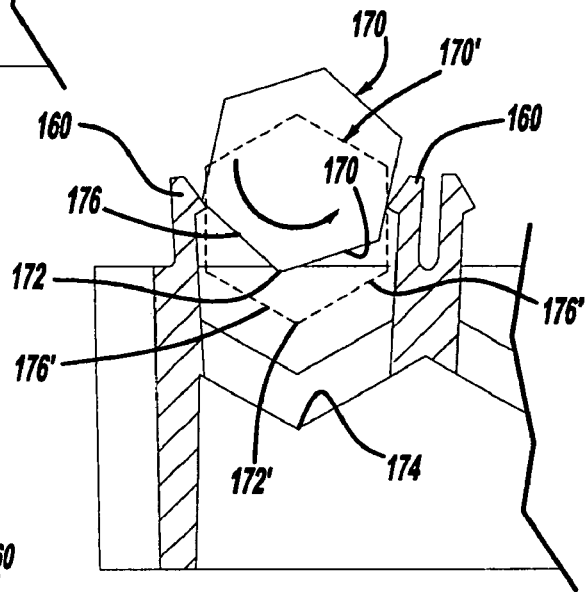
FIG. 19 is a view like FIG. 18 with the tool in a second position.
Figure 20:
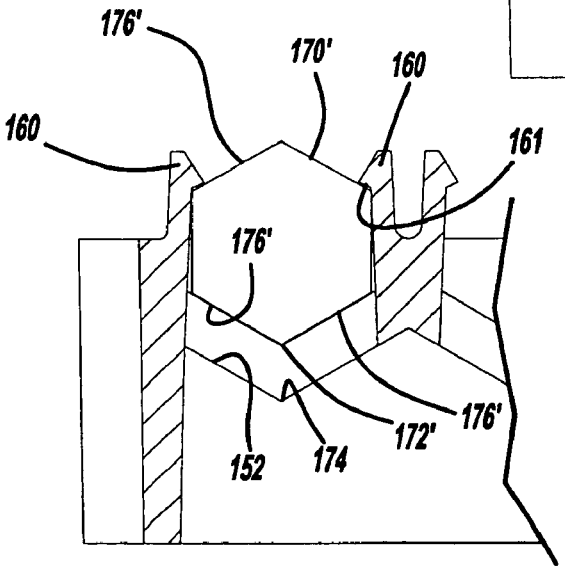
FIG. 20 is a view like FIG. 18 with the tool in a seated position.

FIGS. 18-20 illustrate the insertion of a polygonal cross-section shaped tool into the fingers 124. As shown in FIG. 18, a tool bit 170 is positioned on top of barbs 160 of the fingers 124. The tool 170 has a hexagonal cross-section with a flat portion spanning between the two fingers 124. As the tool 170 is forced through the fingers 124, the fingers 124 spread apart with respect to one another. As the fingers 124 spread, the barbs 160 rotate the tool 170. The rotation continues until a pair of flats 176 are between the opposing barbs 160. At that time, the tool 170 is self-orientated with an apex 172 pointed forward of the apex 174 of the V-shaped cradle. The tool 170 is continued to be forced down into the V-shaped cradle as illustrated in FIG. 20. As this occurs, the apex 172 of the tool seats into the apex 174 of the V-shaped cradle. Thus, the fingers 124 act to self-align or self-orientate the tool 170 in the V-shaped cradle 152. Thus, the V-shaped cradle 152 receives the tool 170 prohibiting any loose tools within the container. Also, the fingers and V-shaped cradle instantly locate the tool bit 170 in position in the tool receiving recess. The barb surfaces 161 seat on a flat surface 176 of the tool 170 to retain the tool within the recess. In the event an apex 172 of the tool 170 is pointing toward the apex 174 of cradle 152, as shown in phantom in FIG. 18, the fingers 124 spread and allow the tool 170 to drop directly into the cradle 152 with the tool apex 174 aligned to seat in cradle apex 172.

Turning to FIGS. 21-26, a second embodiment of the invention is shown.

Here, the housing members are the same as previously discussed, except that the dove-tail walls are replaced by flat walls. Likewise, the tool retaining inserts have flat side walls.

In their place, the base 42', or the side walls 58', 60', have a roughed raised surface 41. Likewise, the inserts 30' include side walls and a base which include similar roughed surfaces 43. These roughed surfaces 41, 43 with the raised and lowered portions enhance ultrasonic welding. The inserts may be ultrasonically welded, adhered or glued to the pair of housing members.

Figure 22:
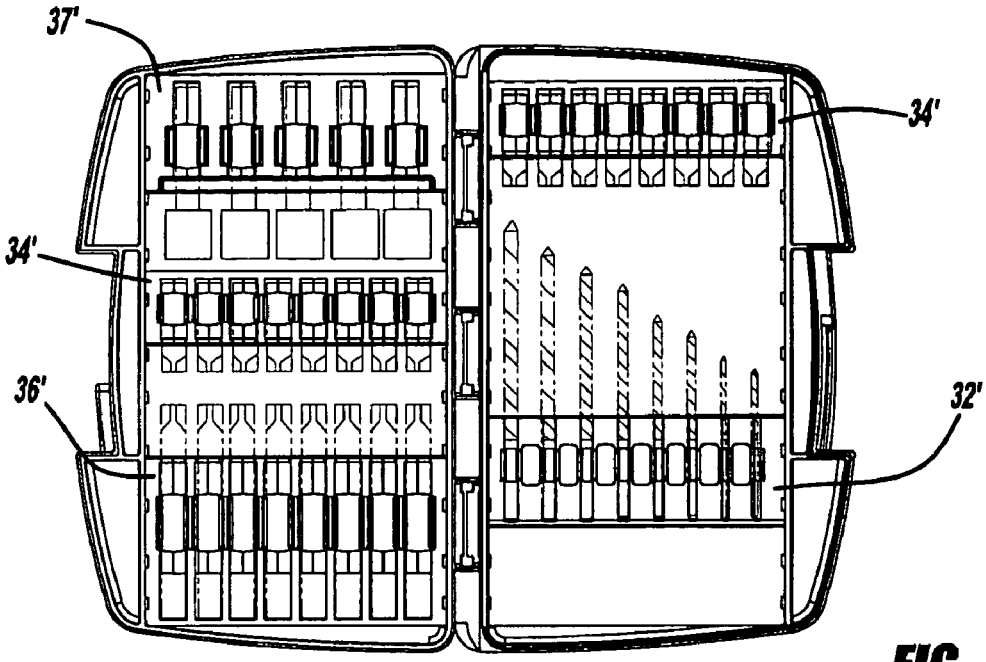
FIG. 22 is a view like FIG. 3 of the alternate embodiment of FIG. 21.
Figure 23:
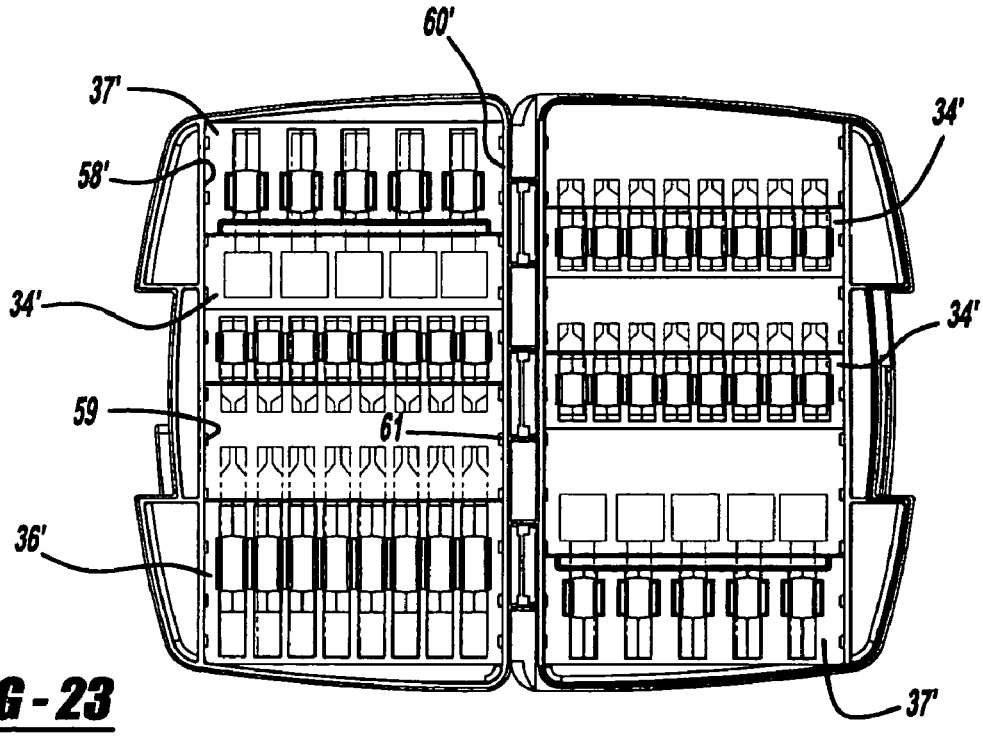
FIG. 23 is a view like FIG. 4 of the alternate embodiment of FIG. 21.
Figure 26:
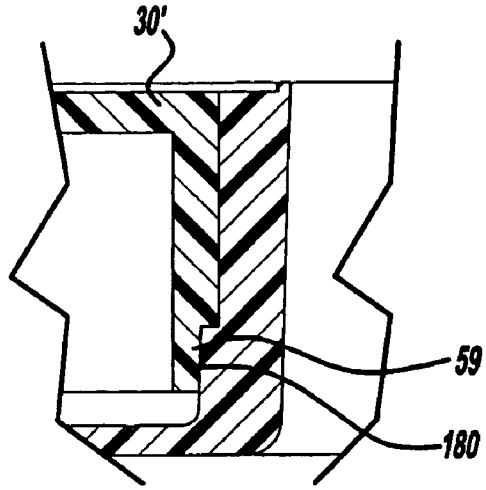
FIG. 26 is a cross-section view of FIG. 21 along lines 26-26 thereof.
Figure 24:
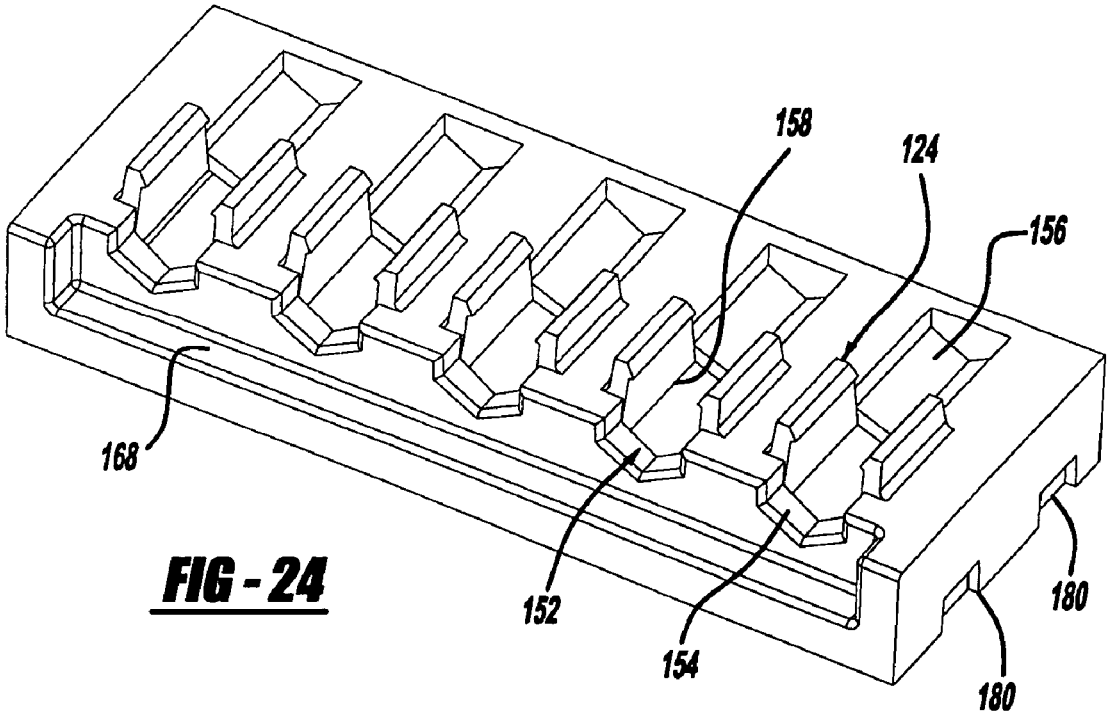
FIG. 24 is a partial perspective view of an insert of FIG. 22 or 23.

FIGS. 22 and 23 illustrate the second embodiment like FIGS. 3 and 4. Here, like FIGS. 3 and 4, the inserts 34', 36', 37' may be positioned in multiple places or positions within the container. Also, the inserts 34', 36', 37' include the receiving members 120 and finger members 124 as well as the V-shaped cradles 152 as explained above. The difference between the previous embodiment is the sides of the inserts.

The walls 58' and 60' include tenons or projecting members 59 and 61. These projecting members 59, 61 are spaced along and do not extend the entire height of the walls 58 and 60'. The projecting members 59 and 61 act to position the inserts 30', 32', 34', 36', 37' in the container to allow for the multiple positioning of the inserts within the housing member. The inserts include recesses or cut-outs 180 which receive the projecting members 59 and 61. The cut-outs 180 are sized to receive the projecting members 59, 61 and are positioned such that the projecting members position the inserts along the housing member. The mating of the projecting member 59, 61 and recess or cut-out 180 enable the inserts to then be adhesively glued or ultrasonically welded to be secured with the housing member.

In the case of the inserts 34', 36' and 37', the insert 34' and the insert 37' would ordinarily include a single cut-out or recess 180 while the insert 36' would include two or three recesses 180 to receive the projecting members 59 and 61. Also, it should be noted that the projecting members could be positioned onto the inserts while the recesses could be formed within the walls 58' and 60'.

Figure 27:
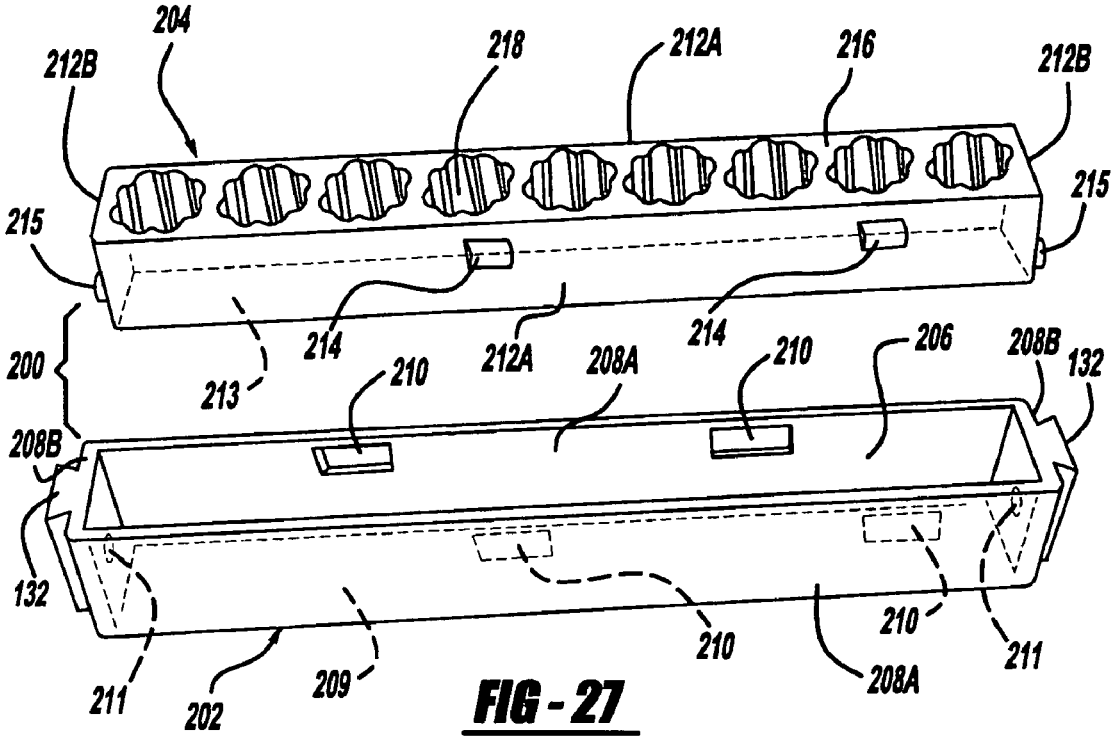
FIG. 27 is an exploded perspective view of an insert according to an additional embodiment of the present invention.
Figure 28:
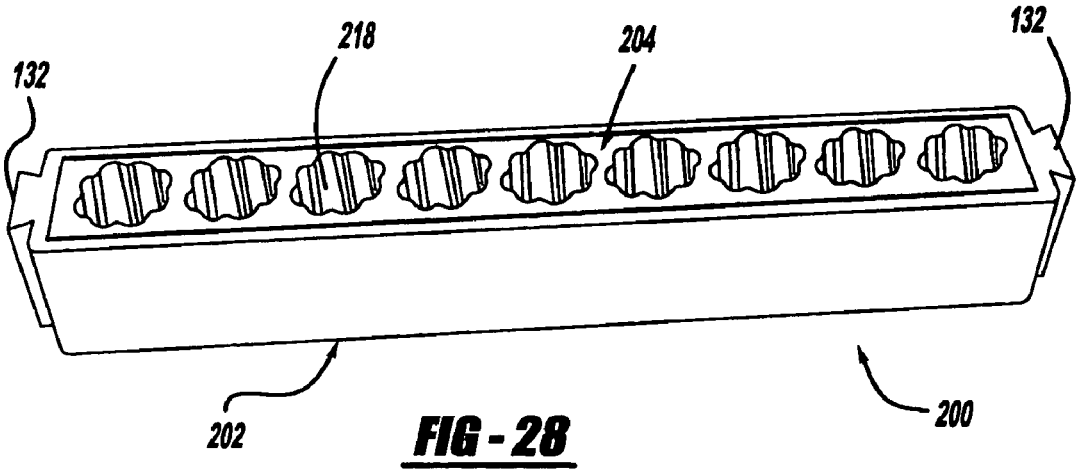
FIG. 28 is an assembled view of the insert of FIG. 27.

With additional reference to FIGS. 27 and 28, an additional insert according to a further embodiment of the invention is illustrated at reference numeral 200. The insert 200 generally includes a base portion 202 and a tool holder 204.

The base portion 202 includes a receptacle 206 defined by four side walls 208 and a bottom portion 209. A pair of first side walls 208A define the length of the receptacle 206 and a pair of second side walls 208B define the width of the receptacle 206. The side walls 208 extend from the bottom portion 209. While the base portion 202 and the tool holder 204 are illustrated as having a generally rectangular shape, the base 202 and the holder 204 can take the form of various other shapes as well.

The first side walls 208A can include one or more recesses 210 on the sides of the first side walls 208A that face the interior of the receptacle 206. The recesses 210 of the different side walls 208A can be aligned with each other or offset from each other as illustrated. The second side walls 208B can also include recesses 211 on the sides of the side walls 208B that face the interior of the receptacle 206. The recesses 211 of the different side walls 208B can be aligned with each other as illustrated or offset from each other. The second side walls 208B can each further include at least one of the mating tenons 132, as described above. The mating tenons 132 extend outward from the second side walls 208B, away from the receptacle 206. The base portion 202 can be made of a variety of different suitable materials such as, for example, any suitable class of plastics based on acrylonitrile-butadiene-styrene (ABS) copolymers.

The tool holder 204 is generally defined by four side walls 212 and a bottom portion 213. A first pair of side walls 212A span the length of the tool holder 204 and a second pair of side walls 212B span the width of the tool holder 204. The first pair of side walls 212A can include one or more bosses 214. The bosses 214 are sized and positioned to mate with the recesses 210 in locking engagement. As illustrated, the bosses 214 are curved protrusions that bow outward from the side walls 212A. However, the bosses 214 can be of any shape or size that permits cooperation with the recesses 210. Further, the position of the bosses 214 and the recesses 210 can be reversed such that the bosses 214 are positioned on the base 202 and the recesses 210 are positioned on the tool holder 204.

The bosses 214 of the different first side walls 212A can be offset from each other as illustrated or aligned with each other. The second pair of side walls 212B can include one or more bosses 215. The bosses 215 are sized and positioned to mate with the recesses 211 in locking engagement. As illustrated, the bosses 215 are round protrusions that extend from the side walls 212B. However, the bosses 215 can be of any shape or size that permits cooperation with the recesses 211. Further, the orientation of the bosses 215 and the recesses 211 can be reversed such that the bosses 215 are on the base portion 202 and the recesses 211 are on the tool holder 204.

Figure 30:
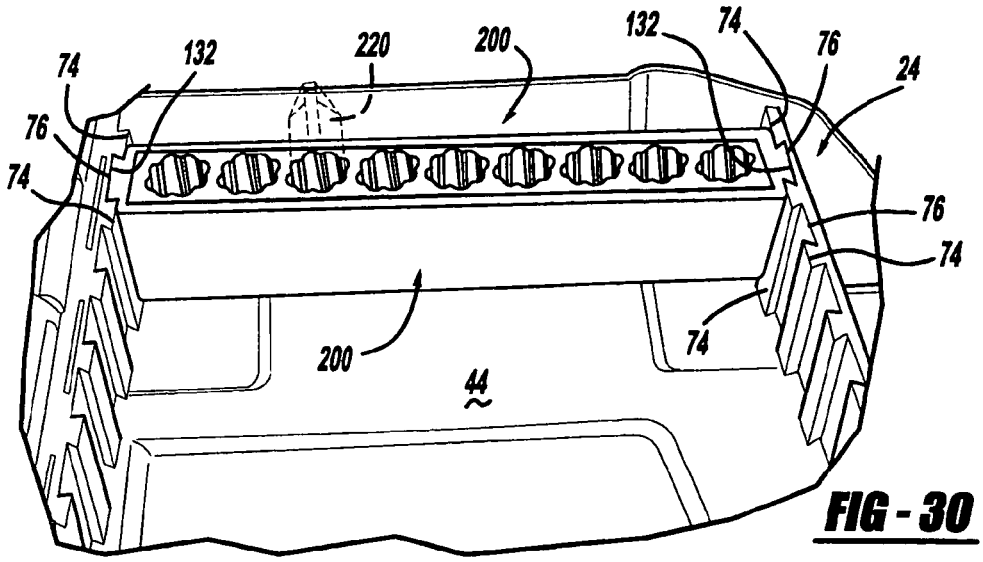
FIG. 30 is an assembled view of the insert of FIG. 27 seated within the tool container of the present invention.
Figure 31:
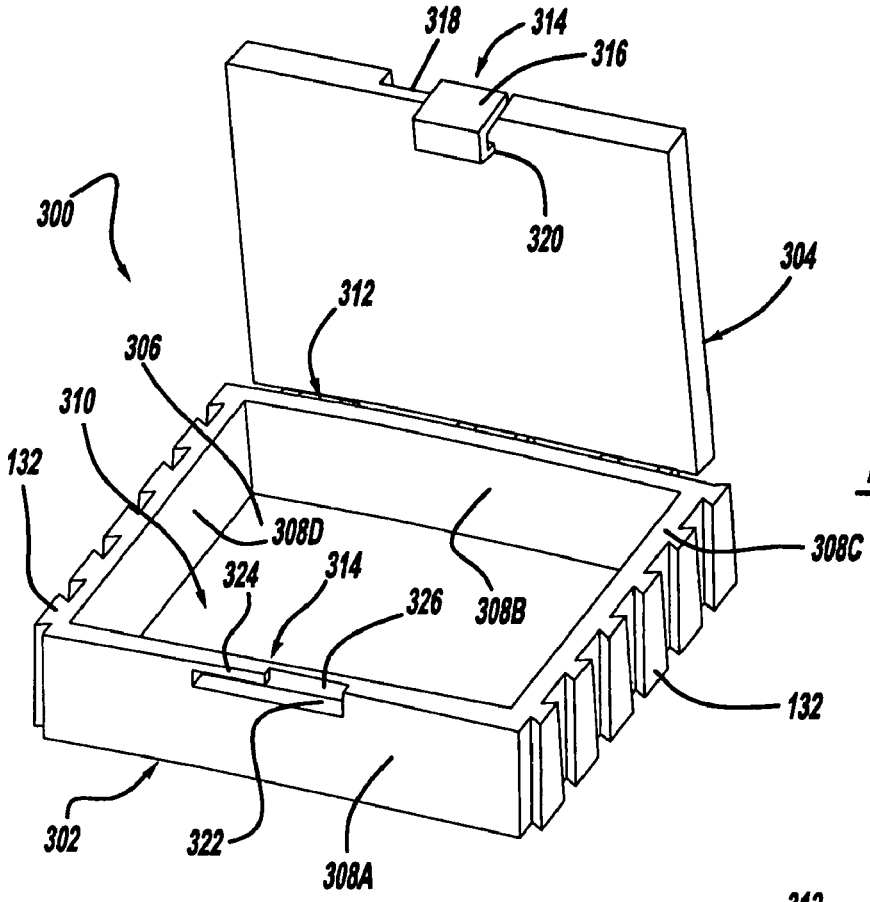
FIG. 31 is a perspective view of an insert according to an additional embodiment of the present invention, the insert having a lid positioned in an open position.

The tool holder 204 further includes an upper surface 216. At the upper surface 216 are one or more tool receivers 218. As illustrated, the tool receivers 218 are in the form of receptacles recessed within the upper surface 216. The receivers 218 can also be of any suitable design to support and store items, such as screw and/or drill bits 220, in a vertical orientation in relation to the base 44 of the housing member 24, as illustrated in FIG. 30, or the base 42 of the housing member 22. The receivers 218 are sized and shaped to receive at least a portion of the items to be stored.

The tool holder 204 can be made of a variety of different materials that can retain the tools, such as the drill bits 220, within the receivers 218. For example, the tool holder 204 can be a flexible or elastomeric material, such as a rubber or a rubber-like material, that will expand to receive the item to be retained and provide a biasing force upon the item to retain the item within the receiver 218. For example, the tool holder 204 can be any suitable flexible/elastic polyvinyl chloride (PVC) material. In some applications, the flexible/elastic PVC material can have the following properties:

| Physical Properties | |
|---|---|
| Tensile Strength | about 1.3 kg |
| Tensile Elongation | about 288% |
| Heat Distortion Rate | about 20% |
| Cold Resistance | about −10° C. |
| Specific Gravity | about 1.389 S.G. |
| Hardness | about A86 Shore-A/6 mm |

In addition to making the tool holder 204 out of a flexible or rubber material, such as flexible PVC, any of the other inserts described herein, such as the inserts 30, 32, 34, 36, and 37 and the base portion 202 can also include a flexible or rubber material, such as a flexible PVC having the above described characteristics or any other characteristics suitable for the particular application.

Figure 29:
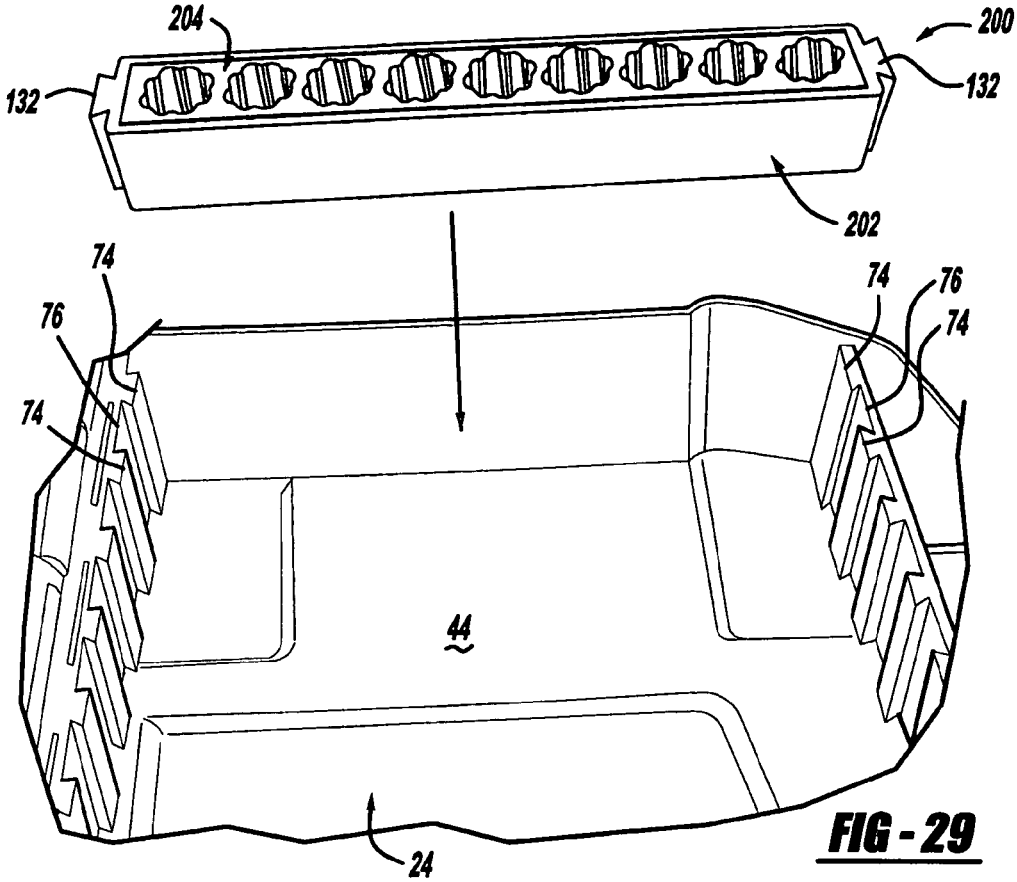
FIG. 29 is an unassembled view of a portion of the tool container of the present invention and the insert of FIG. 27.

With reference to FIG. 28, the insert 200 is assembled by positioning the tool holder 204 within the receptacle 206 such that the bosses 214 cooperate with the recesses 210 and such that the bosses 215 cooperate with the recesses 211 to secure the insert 200 into position. With reference to FIGS. 29 and 30, the assembled insert is secured within the base 44, as illustrated, or the base 42 through cooperation between the mating tenons 132 of the insert 200 and the dove-tail recesses 76 and the dove-tail tenons 74 of the housing members 22/24 in the same manner as described above in relation to the inserts 30, 32, 34, 36, and 37. The insert 200 can be secured at most any location within the base 42/44.

Figure 35:
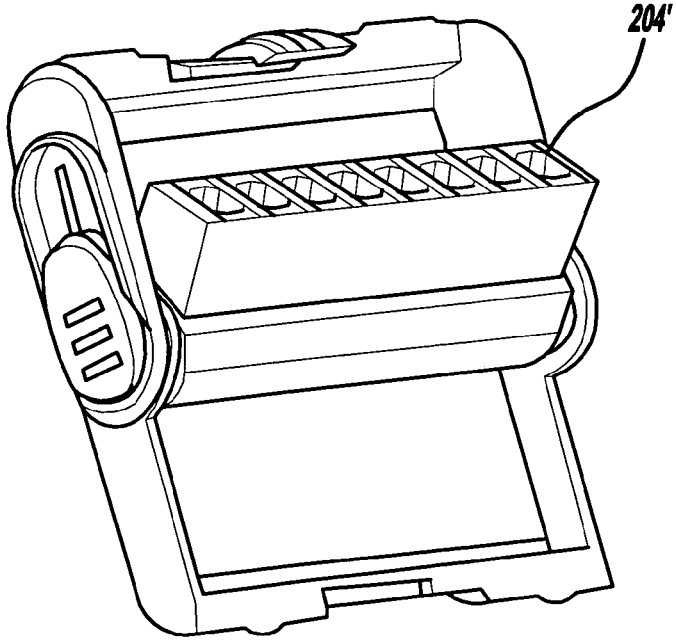
FIG. 35 is a perspective view of a tool container according to another embodiment of the present invention, the tool container including the insert of FIG. 28.

The insert 200 and portions thereof can be used in a variety of different applications. For example, the tool holder 204 can be incorporated into a variety of different devices to retain tools in such devices. With reference to FIG. 35, the tool holder 204' can be incorporated into the illustrated tool container, which is fully described in co-pending and commonly assigned U.S. patent application Ser. No. 10/458,134, which is hereby incorporated by reference.

As illustrated in FIG. 30, the insert 200 is suited to retain small (approximately 1-inch in length) drill or screw bits 220. In the present embodiment, the bits 220 are supported vertically in relation to the base 44. By storing the bits 220 vertically, the insert 200 conserves space in the housing members 22/24 to permit storage of a greater number of bits 220 as compared to inserts that store bits horizontally in relation to the base 44. The housing members 22/24 can each optionally include multiple inserts 200 to store an even greater number of bits 220. However, it should be understood that such advantages do not preclude storage of the bits 220 horizontally if desired.

With additional reference to FIGS. 31-34, an additional insert according to another embodiment of the invention is illustrated at reference numeral 300. The insert 300 is generally a container with a movable lid for storing various items, such as screws, drill bits, nails, and most any other item desired by the user. The insert 300 generally includes a main body 302 and a lid 304.

The main body 302 includes a base 306 that is surrounded by four sidewalls 308A, 308B, 308C, and 308D. The base 306 and the sidewalls 308 generally define a receptacle 310. While the main body 302 is illustrated as having four side walls 308 and a generally square shape, the main body 302 can be of various other shapes and have most any number of side walls 308. The side walls 308C and 308D can each include one or more of the mating tenons 132 described above. The mating tenons 132 can extend from an exterior side surface of the side walls 308C and 308D that is opposite to the receptacle 306. Further, the mating tenons 132 can extend from the other side walls 308A and 308B to vary the orientation of the insert 300 within the base 42/44.

The main body 302 can be made of a variety of different suitable materials, such as any suitable class of plastics based on acrylonitrile-butadiene-styrene (ABS) copolymers. Further, the main body 302 can include a flexible material, such as a flexible/elastic PVC material having the properties set forth above in connection with the description of the tool holder 204, or any other suitable properties depending on the application.

The lid 304 can be dimensioned and shaped to cover a portion of or all of the receptacle 310. The lid 304 can be made of any suitable material, such as a polymeric plastic. The lid 304 can be transparent to permit viewing of the contents of the receptacle 310 or non-transparent.

Figure 32:
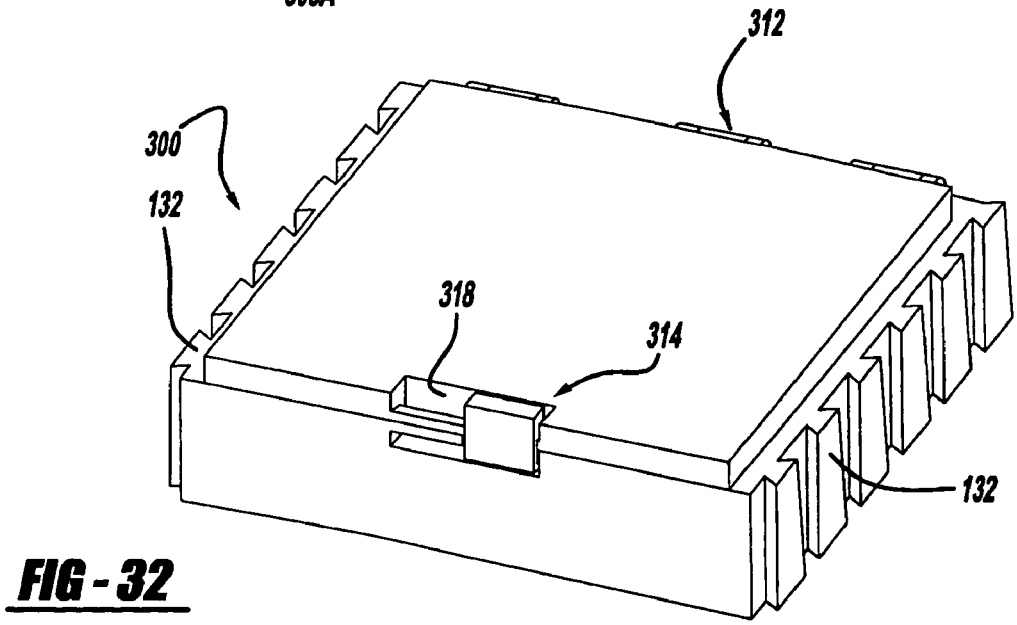
FIG. 32 is similar to FIG. 31 with the lid positioned in a closed position.

The lid 304 can be secured to the main body 302 in any suitable manner and at a variety of different locations. For example, the lid 304 can be slidably or rotationally secured to the main body 302. As illustrated, the lid 304 is rotationally secured to the side wall 308B using one or more hinges 312. The hinges 312 permit rotation of the lid 304 between an open position (FIG. 31) and a closed position (FIG. 32). The hinges 312 can be any suitable type of hinge. Further, the lid 304 can be secured to any of the other side walls 308 in addition to the side wall 308B.

The lid 304 can be secured in the closed position (FIG. 32) by a locking mechanism 314. The locking mechanism 314 can take the form of any suitable locking mechanism. As illustrated, the locking mechanism includes components on both the lid portion 304 and the sidewall 308A. The lid 304 includes a sliding locking tab 316. The tab 316 can be secured to an edge of the lid 304 that is closest to the sidewall 308A when the lid 304 is in the closed position (FIG. 32). The tab 316 is secured to a recess 318 of the lid 304 in any suitable manner that allows the tab 316 to slide within the recess 318. The tab 316 has a hook portion (FIG. 31) 320 that extends beneath the lid 304.

The portion of the locking mechanism 314 that is on the side wall 308A generally includes a notch 322 that is recessed within the side wall 308A. The upper portion of the notch 322, which is closest to the lid 304, is partially bordered by a rail 324. The rail 324 only partially borders or covers the notch 322 and includes an open portion 326 in the area where the rail 324 is not present. The open portion 326 is sized and positioned to receive the hook portion 320 of the tab 316.

Figure 33:
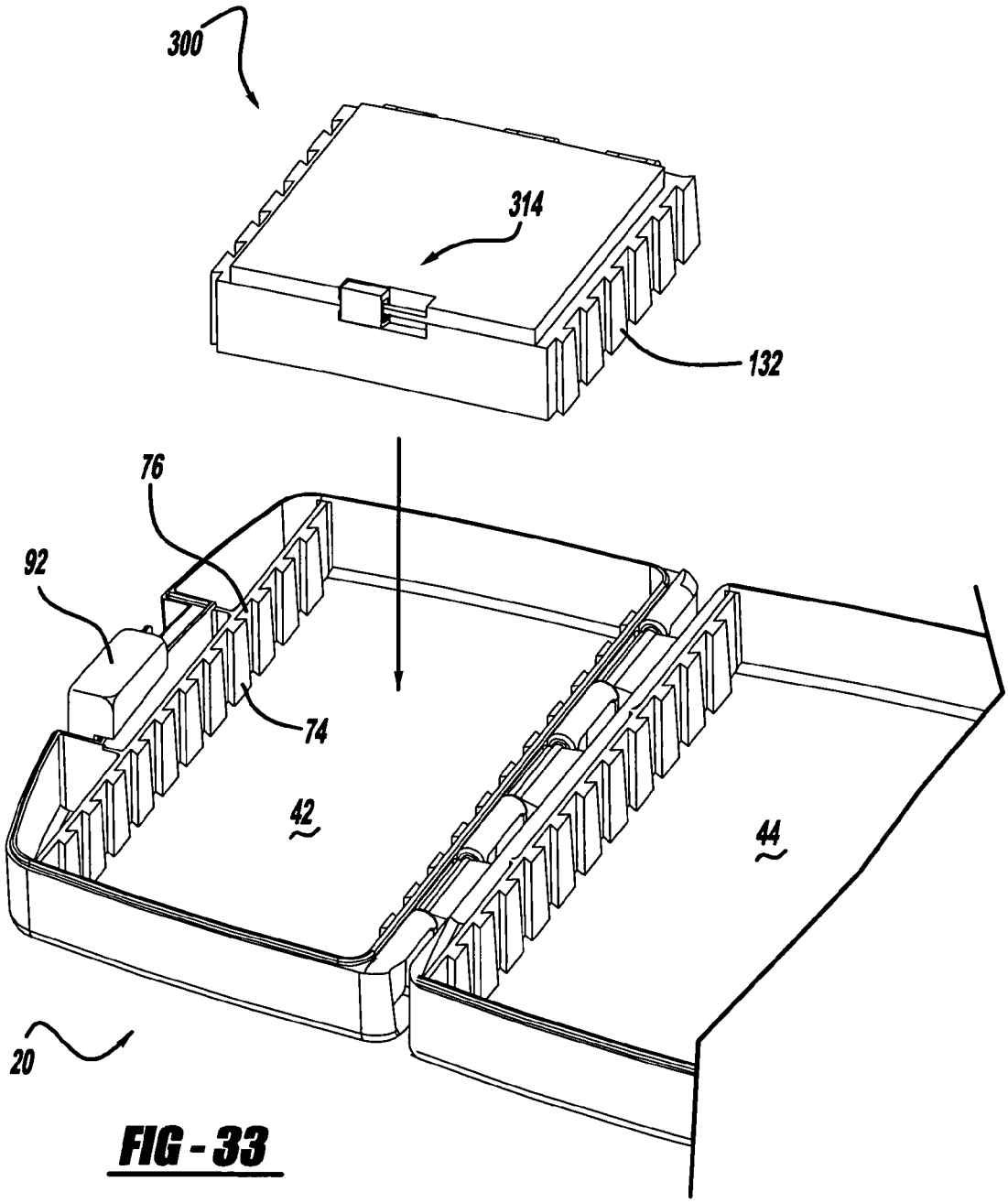
FIG. 33 is an unassembled perspective view of a portion of the tool container of the present invention and the insert of FIG. 31.
Figure 34:
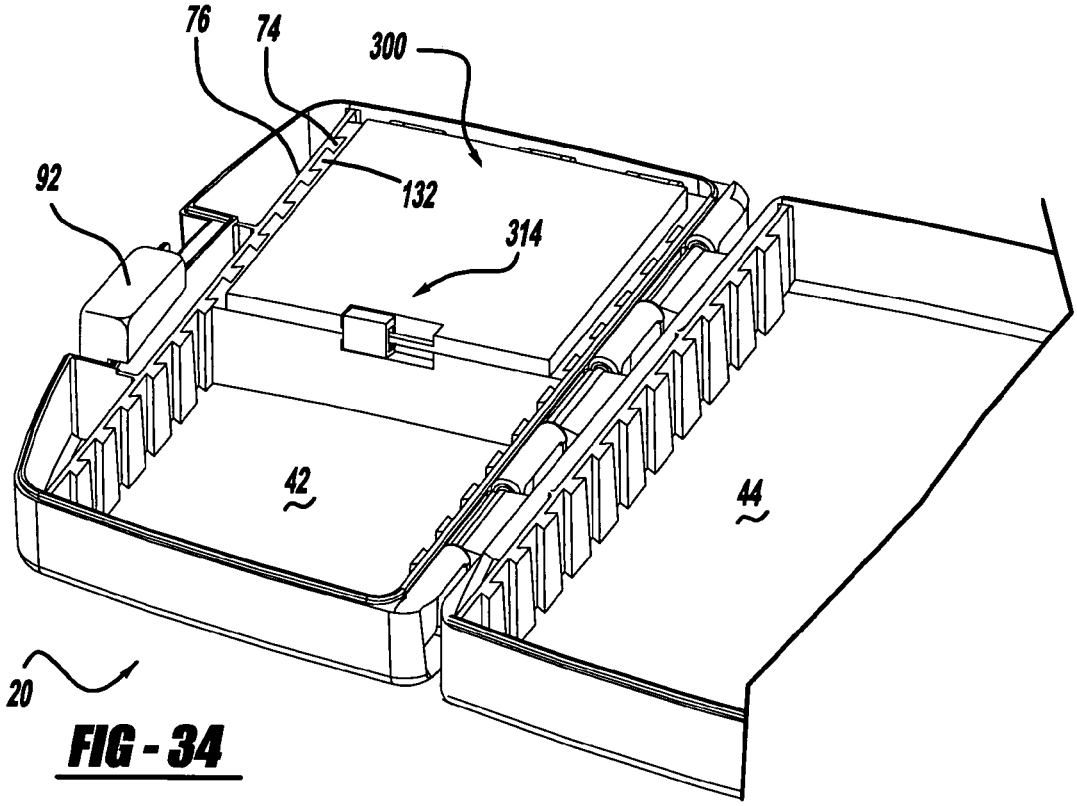
FIG. 34 is an assembled perspective view of the insert of FIG. 31 seated within the tool container of the present invention.

To lock the lid 304 in the closed position, the lid 304 is first moved to the closed position so that the hook portion 320 of the locking tab 316 passes over the open portion 326 of the notch 322 (FIG. 32). The locking tab 316 is then slid within the recess 318 and the notch 322 such that the hook portion 320 at least proximately abuts the rail 324 (FIGS. 33 & 34). The rail 324 obstructs the hook portion 320 and prevents the locking tab 316, and thus the lid 304, from being lifted upward and out of engagement with the notch 322. Therefore, the lid 304 is locked in the closed position when the tab 316 is positioned such that the hook portion 320 is beneath and at least proximately abutting the rail 324.

With reference to FIGS. 33 and 34, the insert 300 is secured within the base 42, as illustrated, or the base 44 through cooperation between the mating tenons 132 of the insert 300 and the dove-tail recesses 76 and the dove-tail tenons 74 of the housing members 22/24 in the same manner as described above in relation to the inserts 30, 32, 34, 36, 37, and 200. The insert 300 can be secured at most any location within the base 42/44.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A tool container comprising:

two housing members pivotally coupled with one another for opening and closing with respect to one another, at least one housing member defining a cavity for receiving tools, said cavity defined by a base and a wall extending from said base, at least one of said wall and said base including a plurality of first retaining features; and an insert for retaining at least one tool, said insert having a surface with a plurality of second retaining features operable to cooperate with said first retaining features to secure said insert at one of a variety of different positions within said housing members when engaged with different said first retaining features, said insert including an elastomeric portion operable to engage and retain said tool;

wherein said elastomeric portion is a tool holder seated within a base portion; and wherein said base portion includes a first locking feature and said elastomeric portion includes a second locking feature, said first locking feature cooperates with said second locking feature to retain said elastomeric portion within said base portion.

2. The tool container of claim 1, wherein said first retaining features include a plurality of alternating first dove-tail recesses and first tenons and said second retaining features include a plurality of alternating second dove-tail recesses and second tenons;

wherein said first tenons cooperate with said second recesses and said second tenons cooperate with said first recesses to secure said insert in said cavity.

3. The tool container of claim 1, wherein said elastomeric portion comprises elastomeric polyvinyl chloride.

4. The tool container of claim 1, wherein said elastomeric portion has at least one of the following physical properties: a tensile strength of about 1.3 kg, a tensile elongation of about 288%, a heat distortion rate of about 20%, a temperature resistance of about −10° C., a specific gravity of about 1.389 S.G., and a hardness of about A86 Shore-A/6 mm.

5. The tool container of claim 1, wherein said base portion comprises a suitable polymeric material based on acrylonitrile-butadiene-styrene.

6. The tool container of claim 1, wherein said elastomeric portion includes a plurality of receptacles to retain said tools.

7. The tool container of claim 1, wherein said elastomeric portion is operable to retain said tools in an orientation that is at least approximately perpendicular to said base.

8. The tool container of claim 1, wherein said elastomeric portion completely surrounds a surface of said tool.

9. A tool container comprising:

a housing member defining a cavity for receiving tools, said cavity defined by a base and a wall extending from said base, said wall including a plurality of first securement members; and an insert for retaining tools, said insert being multi-positionable in said housing member, said insert having a surface with a second securement member for cooperating with said first securement members to secure said insert within said housing member, said insert is positionable at different points within said housing member through cooperation between said second securement member with different said first securement members;

said insert includes an elastomeric portion operable to engage and retain said tool;

wherein said elastomeric portion is a tool holder seated within a base portion; and wherein said base portion includes a first locking feature and said elastomeric portion includes a second locking feature, said first locking feature cooperates with said second locking feature to retain said elastomeric portion within said base portion.

10. The tool container of claim 9, wherein said plurality of first securement members includes a plurality of alternating first dove-tail recesses and first tenons and said second securement member includes a plurality of alternating second dove-tail recesses and second tenons;

wherein said first tenons cooperate with said second recesses and said second tenons cooperate with said first recesses to secure said insert in said cavity.

11. The tool container of claim 9, wherein said elastomeric portion comprises elastomeric polyvinyl chloride.

12. The tool container of claim 9, wherein said elastomeric portion has at least one of the following physical properties: a tensile strength of about 1.3 kg, a tensile elongation of about 288%, a heat distortion rate of about 20%, a temperature resistance of about −10° C., a specific gravity of about 1.389 S.G., and a hardness of about A86 Shore-A/6 mm.

13. The tool container of claim 9, wherein said insert portion comprises a suitable polymeric material based on acrylonitrile-butadiene-styrene.

14. The tool container of claim 9, wherein said elastomeric portion includes a plurality of receivers to retain said tools.

15. The tool container of claim 9, wherein said elastomeric portion is operable to retain said tools in an orientation that is at least approximately perpendicular to said base.

16. The tool container of claim 9, wherein said elastomeric portion completely surrounds a surface of at least one of said tools.

17. A method of making a tool container comprising:

providing a housing member having a cavity for receiving tools, said cavity defined by a base and a wall extending from said base, said wall including a plurality of first securement members; and providing an insert for retaining tools, said insert being multi-positionable in said housing member, said insert having a surface with a second securement member for cooperating with said first securement members to secure said insert within said housing member, said insert is positionable at different points within said housing member through cooperation between said second securement member with different said first securement members, said insert including an elastomeric portion operable to engage and retain said tool, said elastomeric portion changes shape upon engaging said tool, said tool is retained by said insert due to interaction between said elastomeric portion and said tool;

wherein said providing an insert step further comprises providing a tool holder with said elastomeric portion seated within a base portion; and further comprising providing said base portion with a first locking feature and providing said elastomeric portion with a second locking feature, said first locking feature cooperates with said second locking feature to retain said elastomeric portion within said base portion.

18. The method of claim 17, further comprising providing said plurality of first securement members with a plurality of alternating first dove-tail recesses and first tenons and providing said second securement member with a plurality of alternating second dove-tail recesses and second tenons;

wherein said positioning and securing step comprises positioning said first tenons in cooperation with said second recesses and said second tenons in cooperation with said first recesses.

19. The method of claim 17, wherein said providing an insert step comprises providing an insert with said elastomeric portion comprising elastomeric polyvinyl chloride.

20. The method of claim 19, wherein said providing an insert step comprises providing an elastomeric portion having at least one of the following physical properties: a tensile strength of about 1.3 kg, a tensile elongation of about 288%, a heat distortion rate of about 20%, a temperature resistance of about −10° C., a specific gravity of about 1.389 S.G., and a hardness of about A86 Shore-A/6 mm.

21. The method of claim 17, wherein said step of providing a base portion comprises providing a base portion having a suitable polymeric material based on acrylonitrile-butadiene-styrene.

22. The method of claim 17, further comprising providing said elastomeric portion with a plurality of receivers to retain said tools.

23. The method of claim 17, wherein said providing an insert step further comprises positioning said elastomeric portion to retain said tools in an orientation that is at least approximately perpendicular to said base.

24. The method of claim 17, wherein said providing an insert step further comprises providing said elastomeric portion that is operable to completely surround a surface of one of said tools.

* * * * *